US006732412B2

(12) United States Patent
Collotte et al.

(10) Patent No.: US 6,732,412 B2
(45) Date of Patent: May 11, 2004

(54) METHOD AND INSTALLATION FOR THE PRODUCTION OF A CONDENSED NONWOVEN AND CONDENSER DEVICE

(75) Inventors: Michel Collotte, Neuville En Ferrain (FR); Marc Brabant, Hem (FR)

(73) Assignee: Thibeau, Tourcoing (FR)

( * ) Notice: Subject to any disclaimer, the term of this patent is extended or adjusted under 35 U.S.C. 154(b) by 0 days.

(21) Appl. No.: 10/261,002

(22) Filed: Sep. 30, 2002

(65) Prior Publication Data

US 2003/0061686 A1 Apr. 3, 2003

(30) Foreign Application Priority Data

Oct. 3, 2001 (FR) ..... 01 12716

(51) Int. Cl.[7] ..... D01G 25/00
(52) U.S. Cl. ..... 19/308; 19/98; 19/296
(58) Field of Search ..... 19/161.1, 163, 19/296–308, 98, 99, 101, 105, 106 R, 65 A, 115 R, 145.7, 151; 162/300, 301, 306; 198/689.1; 264/518; 425/80.1, 82.1, 83.1, 363, 371

(56) References Cited

U.S. PATENT DOCUMENTS

| | | | | | |
|---|---|---|---|---|---|
| 3,256,569 | A | | 6/1966 | Draving | 19/300 |
| 3,787,930 | A | | 1/1974 | Allen | 19/106 R |
| 4,377,615 | A | | 3/1983 | Suzuki et al. | 428/213 |
| 4,523,350 | A | * | 6/1985 | Schmiedgen et al. | 19/98 |
| 4,668,322 | A | * | 5/1987 | Christensen | 156/209 |
| 4,809,404 | A | | 3/1989 | Lasenga | 19/106 |
| 4,852,217 | A | * | 8/1989 | Bernhardt et al. | 19/98 |
| 4,943,351 | A | * | 7/1990 | Wedel | 162/205 |
| 4,958,404 | A | * | 9/1990 | Lasenga | 19/98 |
| 5,201,103 | A | * | 4/1993 | Frosch et al. | 28/117 |
| 5,226,214 | A | * | 7/1993 | Napolitano | 19/296 |
| 5,584,101 | A | | 12/1996 | Brabant et al. | 19/304 |
| 6,050,469 | A | | 4/2000 | Brabant et al. | 226/183 |
| 6,073,313 | A | * | 6/2000 | Lasenga et al. | 19/99 |
| 6,141,833 | A | * | 11/2000 | S.o slashed.rensen | 19/308 |
| 6,195,845 | B1 | * | 3/2001 | DuPont et al. | 19/300 |

FOREIGN PATENT DOCUMENTS

| | | | | |
|---|---|---|---|---|
| EP | 1 046 731 A1 | | 10/2000 | |
| IT | EP-A-0188177 | * | 7/1986 | D01G/21/00 |

* cited by examiner

*Primary Examiner*—Gary L. Welch
(74) *Attorney, Agent, or Firm*—Weingarten, Schurgin, Gagnebin & Lebovici LLP

(57) ABSTRACT

So as to produce a condensed nonwoven, at least one first nonwoven is produced with the aid of a carding machine (1), said first nonwoven issued from the carding machine is directed to a rotating transfer element (20) by means of one first transport surface (S1), and said first nonwoven is transferred onto a second transport surface (S2) by means of said transfer element (20), the second transport surface (S2) being driven at a linear speed (V2) slower than the circumferential speed of the transfer element (20).

In the transfer zone between the two transport surfaces (S1) and (S2), the first nonwoven is preferably kept against the surface of the transfer element (20) by means of suction.

Application: production of heavy condensed nonwovens, especially having a weight of more than 80 g/m$^2$.

18 Claims, 2 Drawing Sheets

METHOD AND INSTALLATION FOR THE PRODUCTION OF A CONDENSED NONWOVEN AND CONDENSER DEVICE

The present invention relates to the technical field for the production nonwovens with the aid of a carding machine. In this particular field, one of the main objects of the invention is to provide a method and installation for producing a nonwoven whose fibres have been re-orientated, said nonwoven being commonly designated as a condensed nonwoven. The invention can be applied in particular, not but exclusively, for the production of synthetic (polypropylene, polyethylene, etc) fibre-based condensed nonwovens having a high weight, and a weight typically greater than 80 g/m$^2$.

PRIOR ART

Nonwovens produced by means of a carding machine can be classified in two categories: "parallel" nonwovens whose fibres are essentially orientated parallel to one another in the machine direction (carding direction); and so-called condensed nonwoven whose fibres have undergone a re-orientation.

In practice, parallel nonwovens are nonwovens whose mechanical properties exhibit an extremely low isotropy with an extremely low mechanical resistance in a transverse direction compared to the machine direction. On the other hand, the condensed nonwovens have from a mechanical point of view a better isotropy owing to the re-orientation of their fibres. In practice, condensed nonwovens have a higher weight (g/m$^2$) and are more mechanically resistant in the transverse direction compared with the parallel nonwovens.

Usually, so as to produce a condensed nonwoven, a doffer cylinder and at least one first condenser cylinder are used at the outlet of the carding machine. The said doffer cylinder is juxtaposed at the main cylinder of the carding machine (still commonly referred as the "grand tambour"), and the said first condenser cylinder is juxtaposed to the doffer cylinder. The doffer cylinder is a cylinder having on its periphery a specific clothing whose teeth are orientated in a direction opposite its direction of rotation. said clothing having the functionality to remove one portion of the individual fibres from the main cylinder of the carding machine and to card these fibres so as to render them parallel. The condenser cylinder is also provided on its periphery with a specific clothing whose teeth are orientated in a direction opposite its direction of rotation, said condenser cylinder being rotated in a direction opposite the rotating direction of the doffer and with a clearly slower circumferential speed. This difference of speeds allows a loading of the clothing of the condenser cylinder with the parallel fibres issued from the doffer cylinder, said fibres in addition being re-orientated (or mixed up) at the time they are transferred between the two cylinders. This re-orientation is explained by the fact that, when transferred, the fibres are upturned by being retained at their front portion by the clothing of the condenser cylinder driven at a slow speed and by being entrained at their rear portion at higher speed by the clothing of the doffer cylinder. So as to increase the weight per square metre of the condensed nonwoven, it is possible to provide a second condenser cylinder juxtaposed to the first condenser cylinder and driven with a slower speed.

The condensed nonwoven obtained at the outlet of the carding machine, that is to say the condensed nonwoven obtained at the outlet of the last condenser cylinder of the carding machine, is then transported by any known device to a consolidation station which is selected according to the targeted application for the nonwoven (binding of fibres by water jets, calendering, needling, etc).

The difference of speeds between the condenser cylinder and the preceding cylinder directly conditions the weight of the nonwoven obtained. However, it has been observed in practice that this difference of speeds cannot be too great as beyond a certain limit, waves are created in nonwoven when it passes from one cylinder clothing to another, which results in deteriorating the quality of the condensed nonwoven produced at the carding machine outlet. This limitation is expressed by a limitation concerning the weight (per square meter) of the non woven produced. Generally speaking, by optimising the doffer cylinders and condensers cylinder of the carding machine, it is possible to obtain synthetic fibre-based condensed nonwoven of the polypropylene type having at the most a weight per square meter between 60 g/m$^2$ and 80 g/m$^2$.

Amongst other technical solutions for producing a condensed nonwoven, it has already been recommended to replace, at the outlet of the carding machine, the previously described conventional condenser cylinder with a condenser element without any clothing on its periphery. This type of technical solution is described for example in patent application GB-A-962162 or in U.S. Pat. No. 3,787,930.

In patent application GB-A-962162, it is more particularly taught to implement a smooth suction condenser drum which picks up the fibres directly from the periphery of the main drum of the carding machine (without any intermediate doffer cylinder). The picking up of the fibres from the periphery of the carding machine drum is effected via the suction of the condenser drum. In one preferred embodiment variant, so as to help in taking off the fibres retained at the periphery of the main drum of the carding machine, an additional flow of air is provided in the form of a jet of air blown in the direction of the teeth or equivalent of the clothing of the main drum.

In U.S. Pat. No. 3,787,930, a condensed nonwoven is formed with the aid of two belt conveyors adjacent to the doffer cylinder of the carding machine and a suction of fibres in the transfer zone between the doffer cylinder and the belt conveyors.

Firstly, to the knowledge of the Applicant, the solutions described in said publications GB-A-962162 and U.S. Pat. No. 3,787,930 have never been industrially exploited. Secondly, as these solutions are comparable to the conventional solution with a condenser cylinder equipped with a peripheral clothing, the nonwoven undergoes condensation at the time it is formed from fibres picked up from an upstream cylinder, also provided with a peripheral clothing, it can be assumed that the same limitations will be encountered with these solutions as for the conventional solution in terms of differences of speed and thus in terms of weight of the produced condensed nonwoven.

SUMMARY OF THE INVENTION

The present invention seeks to provide a new method for the production of a condensed nonwoven.

According to this method, at least a first one nonwoven is conventionally produced with the aid of a carding machine.

According to the invention, said first nonwoven web is made to undergo a condensing operation. To this effect, said first nonwoven issued from the carding machine is transported to a rotating transfer element by means of a first transport surface. Said first nonwoven is transferred onto a second transport surface by means of said transfer element, the second transport surface being driven at a linear speed slower than the circumferential speed of the transfer element. The speed differential between the transfer cylinder and the second transport surface allows an accumulation of fibres in the transport zone between these two elements and thus a re-orientation of the fibres of the first nonwoven. Thus, from this first nonwoven, a condensed nonwoven is formed having a weight per square meter greater than the weight per square meter of the first nonwoven issued from the carding machine.

In the method of the invention and contrary to the case of aforesaid solutions of the prior art, the condensing operation is not effected during formation of the nonwoven but at a subsequent stage on a nonwoven already formed and derived from a carding machine. It has been observed that this condensing operation carried out at a subsequent stage on a nonwoven already formed would surprisingly make it possible to obtain a condensing rate much higher than that obtained with a conventional solution without adversely affecting the quality of the produced nonwoven.

Another object of the invention is to provide a condenser device for condensing nonwovens. This device comprises first and second transport surfaces and a rotating transfer element which during operation is able to transfer a nonwoven from the first to the second transport surface; during operation, the linear speed of the second transport surface is slower than the circumferential speed of the transfer element.

Another object of the invention is to provide an installation for producing a condensed nonwoven, said installation comprising a carding machine able to produce at least one first nonwoven and the aforesaid condenser device. The carding machine and the condenser device are arranged so that said first nonwoven produced by the carding machine is placed at the carding machine outlet on the first transport surface of the condenser device.

BRIEF DESCRIPTION OF THE DRAWINGS

Other characteristics and advantages of the invention shall appear more clearly from a reading of the following description of a preferred embodiment variants of an installation of the invention, said description being given by way of non-restrictive example with reference to the accompanying drawings on which.

DETAILED DESCRIPTION

Figure 1:
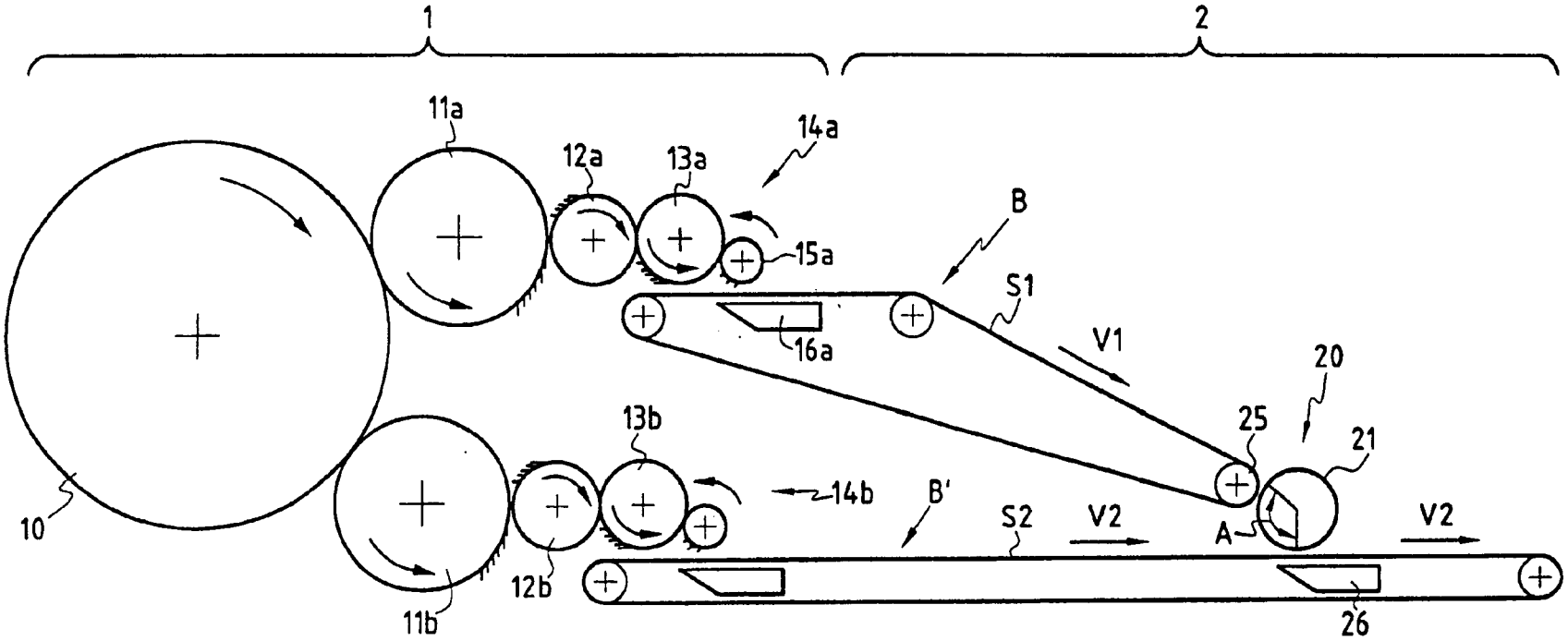
FIG. 1 diagrammatically represents an installation for producing a nonwoven comprising a carding machine with two outlets and a condenser device according to the invention.
Figure 2:
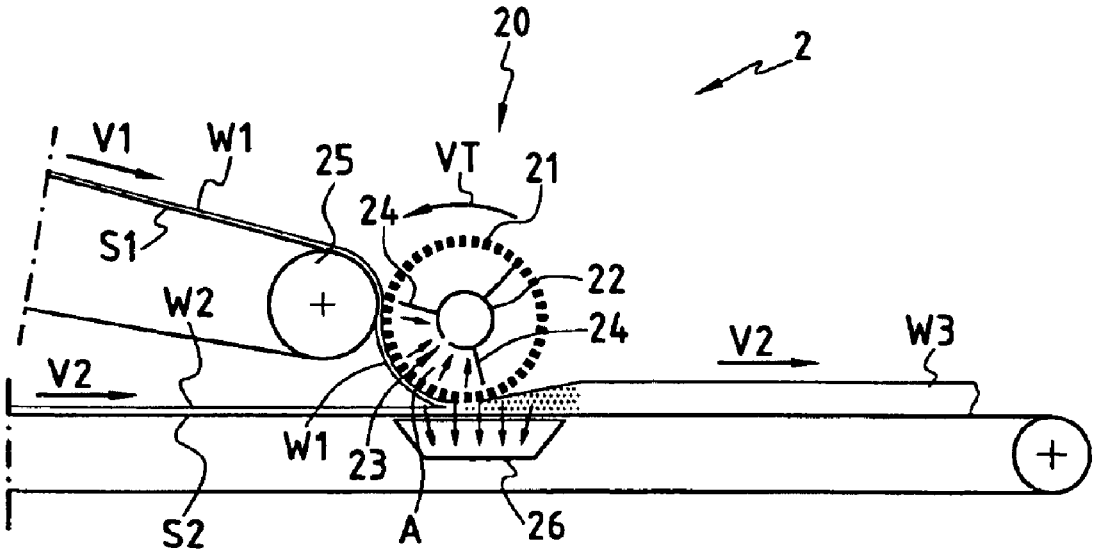
FIG. 2 is a more detailed view of the condenser device of FIG. 1.

FIG. 1 shows an installation conforming to a preferred embodiment variant of the invention allowing the production of a condensed nonwoven web identified by reference W3 on FIG. 2. This installation includes a carding machine 1 with two upper and lower outlets and a device 2 which, with reference to FIG. 2, is able to form the condensed nonwoven (W3) from a first non-woven web (W1) derived from the upper outlet of the carding machine 1, and from a second non woven web (W2) derived from the lower outlet of the carding machine 1.

The carding machine 1 is a conventional carding machine and is fully known in the field of the production of nonwoven from synthetic fibres. For reasons of simplification, only the main elements of this carding machine 1 required for understanding of the invention have been shown, the other known elements of the carding machine, especially the worker rollers at the periphery of the main drum and the input device for feeding the main drum have not been shown. In a usual way, this carding machine 1 comprises a main drum 10. Mounted at the upper portion and at the periphery of this main drum is an upper doffer cylinder 11*a* followed by two condenser cylinders 12*a* and 13*a* and a take-off device 14*a*. The upper cylinder 11*a*, the two condenser cylinders 12*a* and 13*a* and the take-off device 14*a* form the upper outlet of the carding machine 1.

In a usual way, during functioning, the upper doffer cylinder 11*a* recovers in its clothing a portion of the fibres at the periphery of the main drum 10 and renders the fibres parallel. During functioning, the first condenser cylinder 12*a* is driven at a circumferential speed clearly slower than the circumferential speed of the upper doffer cylinder 11*a* so that condensing (re-orientation) of the parallel fibres derived from the doffer cylinder 11*a* is obtained at the time the said fibres are transported into the clothing of the condenser cylinder 12*a*. During functioning, the second condenser cylinder 13*a* is driven with a circumferential speed slower than that of the first condenser cylinder 12*a*, which makes it possible to increase the condensing (re-orientation) of the fibres. Thus, formed at the periphery of the second cylinder 13*a* is a first condensed nonwoven (not shown on FIG. 1) having a given initial weight which depends on the respective speeds of the cylinders 11*a*, 12*a* and 13*a*.

During functioning of the installation, this first nonwoven is transported at the periphery of the second condenser cylinder 13*a* up to aforesaid a take-off device 14*a*. This take-off device 14*a* is able to place the first nonwoven derived from the upper outlet of the carding machine 1 onto a belt conveyor (B) whose upper strand forms a transport surface (S1) and which is driven at a constant predetermined linear speed (V1). With reference to FIG. 2, the first nonwoven, derived from the upper outlet of the carding machine 1 and transported at the speed (V1) by the transport surface S1, is given the reference W1.

The take-off device 14*a* was already described in the European patent application EP-A-0704561, a publication in which one skilled in the art could refer to for a detailed understanding of the structure and functioning of this take-off device. Basically, this take-off device 14*a* includes a take-off cylinder 15*a* having on its periphery an isosceles or equivalent clothing whose purpose is to pick up the first condensed nonwoven web at the periphery of the second condenser cylinder 14*a*. So as to contribute in taking-off the first non-woven from the periphery of the take-off cylinder 15*a*, the belt conveyor B is permeable to air, and the take-off device includes a suction box 16*a* or any other equivalent suction element which during functioning makes it possible to press via suction the first nonwoven web against the surface of the belt conveyor B, at least in the transition zone between the take-off cylinder 15*a* and the belt conveyor B.

The carding machine 1 comprises a lower outlet, identical from a structural point of view to the previously described upper outlet. This lower outlet is made up of a lower doffer cylinder 11*b*, two successive condenser cylinders 12*b* and 13*b* and a take-off device 14*b* which makes it possible to pick up the condensed nonwoven web at the condenser cylinder periphery 13*b* and place said condensed nonwoven onto a belt conveyor B'. The upper strand of the belt conveyor B' forms a transport surface S2 and is driven with a predetermined constant linear speed V2. During functioning of the carding machine 1, two nonwoven web are thus produced in parallel, namely the first nonwoven web W1 previously described, and a second nonwoven web originating from the lower outlet of the carding machine 1 and given the reference W2 on FIG. 2.

The condenser device 2 of the invention includes, apart from the two previously described transport surfaces S1 and S2, a rotating transfer element 20. In the embodiment variant shown on the figures, this transfer element includes a smooth rotating cylinder 21. Here, a smooth cylinder is understood to be a cylinder not comprising any clothing on its periphery as opposed to the other cylinders of the carding machine 1 and in particular as opposed to the main drum 10, the doffer cylinders 11*a*, 11*b* and the condenser cylinders 12*a*, 13*a*, 12*b* and 13*b*.

Also, according to a preferential characteristic, a sucking transfer element is used. To this effect, in the variant of FIGS. 1 and 2, the cylinder 21 is a perforated cylinder inside which a suction sector A is mounted. This suction sector A is preferably adjustable and during functioning of the device, this suction sector A, after having had its position adjusted, is fixed. More particularly with reference to FIG. 2, mounted coaxially inside the perforated cylinder 21 with the spin axis of said cylinder is a tube 22 which. once its position has been adjusted, is fixed when the cylinder 21 is driven in rotation and which is provided with a longitudinal aperture 23. Secured to the outer face of this tube 22 are two walls 24 delimiting the suction sector A. During functioning, the inside of the tube 22 is placed in a partial vacuum so that suction is created inside the sector A allowing the admission of a flow of air from the outside towards the inside of the cylinder 21 in a region limited to the suction sector A.

The cylinder 21 is mounted so as to be adjacent to the downstream extremity roller 25 used for driving the belt conveyor B. Also, this cylinder 21 is positioned so that it is placed above and close to the transport surface S2.

When the installation of FIG. 1 is functioning, the carding machine 1 produces in parallel two condensed nonwovens W1 and W2 respectively on its upper and lower outlets. The first condensed nonwoven W1 is derived from the upper outlet of the carding machine 1 and is placed on the transport surface S1 upstream of the transfer cylinder 21. The second nonwoven W2 is derived from the lower outlet of the carding machine 1 and is placed on the transport surface S2 upstream of the transfer cylinder 21 of the carding machine 1. These two nonwovens W1 and W2 are transported in parallel respectively by the transport surfaces S1 and S2 up to the transfer cylinder 21.

During functioning, the cylinder 21 is driven in rotation with a circumferential speed (VT) (linear speed of the external surface of the cylinder 21) which is equal to or slightly greater than the linear speed (V1) of the transport surface S1 so that cylinder 21 picks up on its periphery the first condensed nonwoven W1 without destroying the structure of this nonwoven and by, making it undergo an extremely slight stretching, directs it as far as the second transport surface S2. The suction sector A of the cylinder 21 is positioned so as to enable this first nonwoven to be kept under the effect of suction against the surface of the cylinder 21 during the time it is transferred between the first transport surface S1 and the second transport surface S2.

According to the invention, so as to obtain the sought-after condensing effect, the linear speed V2 of the second transport surface S2 is clearly slower than the circumferential speed (VT) of the cylinder 20 and thus slower than the linear speed of the first transport surface S1 so that a condensing (or re-orientation) of the fibers of the first nonwoven W1 mainly occurs when the latter is transferred between the cylinder 21 and the transport surface S2. More specifically, when the fibers of the first nonwoven W1 arrive in the transition zone between the cylinder 21 and the transport surface S2, owing to the slower speed of this transport surface S2, said fibers are suddenly slowed down and accumulate in this transition zone. At the outlet of this transition zone between the cylinder 21 and the transport surface S2, a thicker condensed nonwoven W3 is thus obtained and formed via the superposition of the lower nonwoven web W2 with fibers which originate from the nonwoven W1 and which have been significantly re-orientated. The weight of this condensed nonwoven W3 is greater than the sum of the weights of the nonwoven W1 and W2.

The condenser device 2 preferably includes a suction box 26 or equivalent means which during functioning makes it possible to create through the transport surface S2 at least in the transition zone between the cylinder 21 and the transport surface S2 a suction flow preferably extending over the entire width of this transport surface S2 and able to apply the transported fibres against the transport surface S2.

The weight of the nonwoven W3 obtained at the outlet of the condenser device 2 of FIG. 1 or 2 of course depends on the weight of the two nonwoven W1 and W2 originating from the upper and lower outlets of the carding machine 1, but also and mainly from the speed differential between the transport surface S2 and the circumferential speed of the cylinder 21.

In the following three embodiment examples given by way of indication, the installation of FIG. 1 was used to form a composite polypropylene fibre-based nonwoven having an average titration of 2.2 dtex and an average length of 38 mm.

First Embodiment Example

The circumferential speed of the upper doffer cylinder 11*a* was about 230 m/min, the circumferential speeds of the two condenser cylinders 12*a* and 13*a* were respectively about 120 and 70 m/min. The circumferential speed of the take-off cylinder S1 was about 140 m/min. The linear speed (V1) of the transport surface S1 was about 145 m/min. The first nonwoven W1 (before being picked up by the cylinder 21) had a weight of about 20 g/m$^2$.

The lower doffer cylinder 11*b* was driven at a circumferential speed of about 125 m/min. The two condenser cylinders 12*b* and 13*b* was respectively driven with circumferential speeds of 65 m/min and 38 m/min. The take-off cylinder 14*b* was driven with a circumferential speed of about 48 m/min. The transport surface S2 was driven with a linear speed V2 of about 50 m/min. The weight of the nonwoven W2 was about 43 g/m$^2$.

The transfer cylinder 20 was driven with a circumferential speed (VT) of about 150 m/min, namely a ratio (VT/V2) of about 3. The weight of the condensed nonwoven W3 at the outlet of the condenser device 2 was about 103 g/m$^2$.

Second Embodiment Example

The circumferential speed of the upper doffer cylinder 11*a* was about 246 m/min. The circumferential speeds of the two condenser cylinders 12*a* and 13*a* were respectively about 128 m/min and 75 m/min. The circumferential speed of the take-off cylinder 15*a* was about 150 m/min. The linear speed (V1) of the transport surface S1 was about 155 m/min. The first nonwoven W1 (before being picked up by the cylinder 21) had a weight of about 20 g/m$^2$.

The lower doffer cylinder 11*b* was driven at a circumferential speed of about 100 m/min. The two condenser cylinders 12*b* and 13*b* were respectively driven with circumferential speeds of 52 m/min and 30 m/min. The take-off cylinder 14*b* was driven with a circumferential speed of about 38 m/min. The transport surface S2 was driven with a linear speed V2 of about 40 m/min. The weight of the nonwoven W2 was about 50 g/m$^2$.

The transfer cylinder 20 was driven with a circumferential speed (VT) of about 160 m/min, namely a ratio (VT/V2) of about 4. The weight of the condensed nonwoven W3 at the outlet of the condenser device 2 was about 130 g/m$^2$.

Third Embodiment Example

The circumferential speed of the upper doffer cylinder 11*a* was about 161 m/min. The circumferential speeds of the two condenser cylinders 12*a* and 13*a* were about 84 m/min and 49 m/min respectively. The circumferential speed of the take-off cylinder 15*a* was about 98 m/min. The linear speed (V1) of the transport surface S1 was about 101 m/min. The first nonwoven W1 (before being picked up by the cylinder 21) had a weight of about 20 g/m$^2$.

The lower doffer cylinder 11*b* was driven at a circumferential speed of about 50 m/min. The two condenser cylinders 12*b* and 13*b* were driven with circumferential speeds of 26 m/min and 15 m/min respectively. The take-off cylinder 14*b* was driven with a circumferential speed of about 19 m/min. The transport surface S2 was driven with a linear speed V2 of about 20 m/min. The weight of the nonwoven W2 was about 55 g/m$^2$.

The transfer cylinder 20 was driven with a circumferential speed (VT) of about 105 m/min, namely a ratio (VT/V2) of about 5.25. The weight of the nonwoven W3 at the outlet of the condensation device 2 was about 160 g/m$^2$.

The invention is not limited to the particular embodiment example described above with reference to FIGS. 1 and 2. In particular, it is possible to replace the belt conveyor B by any transport surface and for example by a cylinder or a set of cylinders. It is preferable that the transport surface S2 is flat, at least in the transition zone between the cylinder 21 and said transport surface. Nevertheless, in another embodiment variant of the invention, it is possible to use a curved transport surface S2. The rotating transfer element 20 is not necessarily a cylinder, but can be replaced by any element carrying out the same transfer function, said element possibly being a roller driven by a transport belt.

Tests have demonstrated that it was preferable that the transfer element 20 is of the suction type. In fact, by eliminating suction (suction sector A) or with a too slight suction, it has been observed in a large number of cases that defects quickly appear in the structure of the produced nonwoven. In practice, the flow of air sucked up into the sector A shall be adjusted by increasing it until the defects in the structure of the nonwoven have disappeared.

The invention is not limited to the formation of a nonwoven from two nonwoven webs. The latter can also be advantageously used to embody a condensed nonwoven web from a single nonwoven web W1. In this case, the transport surface S2 does not transport any web upstream of the transfer cylinder 21.

The suction (suction box 26) implemented at the level of the transition zone between the transfer element 20 and the transport surface S2 is optional, especially in the case of a single nonwoven web W1. This suction makes it possible to improve locking of one nonwoven web with respect to the other of the two non-woven webs W1 and W2 at the time they are superimposed.

The invention is not limited to the production of a condensed nonwoven W3 of greater weight from a single condensed nonwoven (W1) or several condensed nonwoven (W1, W2). In particular, the nonwoven web W1 could be a parallel web originating directly from a doffer cylinder and not having been previously condensed by condenser cylinders, the same applying to the nonwoven W2.

The main advantage of the invention concerns the production of heavy nonwovens (weight exceeding 80 g/m$^2$) as it allows high speed ratios between the transport surface (S2) and the transfer element 20 and accordingly the obtaining of significant condensing rates without adversely affecting the quality of the nonwoven produced. In particular and without limiting the scope of the invention, the ratio (VT/V2) between the circumferential speed (VT) of the rotating transfer element and the linear speed (V2) of the second transport surface (S2) is greater than 2 and preferably greater than or equal to 3. This ratio of speeds is fixed case by case according to the sought condensing rate.

What is claimed is:

1. Method for producing a condensed nonwoven (W3) according to which at least one first nonwoven (W1) is produced by means of a carding machine, said method being characterised in that said first nonwoven (W1) issued from the carding machine is transported by means of a first transport surface to a rotating transfer element, said first nonwoven (W1) being transferred onto a second transport surface by means of said transfer element, the second transport surface being driven at a linear speed slower than the circumferential speed of the transfer element and further characterised in that in a transfer zone defined between the two transport surfaces, the first nonwoven (W1) is kept against the surface of the transfer element by means of suction.

2. Method according to claim 1, characterised in that the ratio between the circumferential speed of the rotating transfer element and the linear speed of the second transport surface is greater than 2 and preferably greater than or equal to 3.

3. Method for producing a condensed nonwoven (W3) according to which at least one first nonwoven (W1) is produced by means of a carding machine, said method being characterised in that said first nonwoven (W1) issued from the carding machine is transported by means of a first transport surface to a rotating transfer element, said first nonwoven (W1) being transferred onto a second transport surface by means of said transfer element, the second transport surface being driven at a linear speed slower than the circumferential speed of the transfer element and further characterised in that the ratio between the circumferential speed of the rotating transfer element and the linear speed of the second transport surface is greater than 2.

4. Method for producing a condensed nonwoven (W3) according to which at least one first nonwoven (W1) is produced by means of a carding machine, said method being characterised in that said first nonwoven (W1) issued from the carding machine is transported by means of a first transport surface to a rotating transfer element, said first nonwoven (W1) being transferred onto a second transport surface by means of said transfer element, the second transport surface being driven at a linear speed slower than the circumferential speed of the transfer element and further characterised in that suction is created through the second transport surface, at least in a transition zone defined between the transfer element and said second transport surface.

5. Device for condensing a nonwoven (W1), characterised in that said device comprises a first and a second transport surfaces and a rotating transfer element (20) which during functioning makes it possible to transfer a nonwoven (W1) from the first transport surface to the second transport surface, and in that during functioning, the linear speed of the second transport surface is slower than the circumferential speed of the transfer element and further characterised in that the ratio between the circumferential speed of the rotating transfer element and the linear speed of the second transport surface is adjusted so as to be greater than 2.

6. Device according to claim 5, further comprising suction means for creating suction through the second transport surface, at least in a transition zone defined between the transfer element and said second transport surface.

7. Device for condensing a nonwoven (W1), characterised in that said device comprises a first and a second transport surfaces and a rotating transfer element (20) which during functioning makes it possible to transfer a nonwoven (W1) from the first transport surface to the second transport surface, and in that during functioning, the linear speed of the second transport surface is slower than the circumferential speed of the transfer element and further characterised in that the transfer element is provided with suction means for maintaining the nonwoven (W1) against the surface of the transfer element.

8. Device according to claim 7, characterised in that the transfer element (20) comprises a perforated cylinder (21).

9. Device according to claim 8, further comprising suction means for creating suction through the second transport surface, at least in a transition zone defined between the transfer element and said second transport surface.

10. Installation for the production of a condensed nonwoven (W3), characterised in that said installation comprises a carding machine for producing at least one first nonwoven (W1) and a condenser device according to claim 8, and in that the carding machine and the condenser device are arranged in such a way that said first nonwoven (W1) produced by the carding machine is placed at a carding machine outlet on the first transport surface of the condenser device.

11. Device according to claim 7, further comprising suction means for creating suction through the second transport surface, at least in a transition zone defined between the transfer element and said second transport surface.

12. Installation for the production of a condensed nonwoven (W3), characterised in that said installation comprises a carding machine for producing at least one first nonwoven (W1) and a condenser device according to claim 7, and in that the carding machine and the condenser device are arranged in such a way that said first nonwoven (W1) produced by the carding machine is placed at a carding machine outlet on the first transport surface of the condenser device.

13. Device for condensing a nonwoven (W1), characterised in that said device comprises a first and a second transport surfaces and a rotating transfer element (20) which during functioning makes it possible to transfer a nonwoven (W1) from the first transport surface to the second transport surface, and in that during functioning, the linear speed of the second transport surface is slower than the circumferential speed of the transfer element and further characterised in that said device comprises suction means for creating suction through the second transport surface, at least in a transition zone defined between the transfer element and said second transport surface.

14. Installation for the production of a condensed nonwoven (W3), characterised in that said installation comprises a carding machine for producing at least one first nonwoven (W1) and a condenser device according to claim 9, and in that the carding machine and the condenser device are arranged in such a way that said first nonwoven (W1) produced by the carding machine is placed at a carding machine outlet on the first transport surface of the condenser device.

15. Installation according to claim 14, characterised in that the carding machine comprises at least one second outlet for the production of a second nonwoven (W2), and in that the carding machine and the condenser device are arranged so that said second nonwoven (W2) produced by the carding machine is placed at the carding machine outlet on the second transport surface of the condenser device upstream of the transfer element of said condenser device.

16. Installation for the production of a condensed nonwoven (W3), characterised in that said installation comprises a carding machine for producing at least one first nonwoven (W1) and a device for condensing a nonwoven (W1). characterised in that said device comprises a first and a second transport surfaces and a rotating transfer element (20) which during functioning makes it possible to transfer a nonwoven (W1) from the first transport surface to the second transport surface, and in that during functioning, the linear speed of the second transport surface is slower than the circumferential speed of the transfer element and further characterised in that the carding machine and the condenser device are arranged in such a way that said first nonwoven (W1) produced by the carding machine is placed at a carding machine outlet on the first transport surface of the condenser device.

17. Installation according to claim 16, characterised in that the carding machine comprises at least one second outlet for the production of a second nonwoven (W2), and in that the carding machine and the condenser device are arranged so that said second nonwoven (W2) produced by the carding machine is placed at the carding machine outlet on the second transport surface of the condenser device upstream of the transfer element of said condenser device.

18. Installation for the production of a condensed nonwoven (W3), characterised in that said installation comprises a carding machine for producing at least one first nonwoven (W1) and a Device for condensing a nonwoven (W1), characterised in that said device comprises a first and a second transport surfaces and a rotating transfer element (20) which during functioning makes it possible to transfer a nonwoven (W1) from the first transport surface to the second transport surface, and in that during functioning, the linear speed of the second transport surface is slower than the circumferential speed of the transfer element and further characterised in that the carding machine and the condenser device are arranged in such a way that said first nonwoven (W1) produced by the carding machine is placed at a carding machine outlet on the first transport surface of the condenser device.

* * * * *

UNITED STATES PATENT AND TRADEMARK OFFICE

CERTIFICATE OF CORRECTION

PATENT NO. : 6,732,412 B2
DATED : May 11, 2004
INVENTOR(S) : Michel Collotte et al.

It is certified that error appears in the above-identified patent and that said Letters Patent is hereby corrected as shown below:

Column 6,
Line 38, "S1" should read -- 15a --.

Signed and Sealed this

Thirty-first Day of May, 2005

JON W. DUDAS
*Director of the United States Patent and Trademark Office*